US008126356B2

(12) United States Patent
Watanabe et al.

(10) Patent No.: US 8,126,356 B2
(45) Date of Patent: Feb. 28, 2012

(54) IMAGE FORMING APPARATUS HAVING A LOCK MECHANISM RELEASABLE BY LIFTING AN UPPER COVER

(75) Inventors: Yasunori Watanabe, Nagoya (JP); Takuya Yamaguchi, Toyokawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 609 days.

(21) Appl. No.: 12/339,243

(22) Filed: Dec. 19, 2008

(65) Prior Publication Data

US 2009/0169249 A1 Jul. 2, 2009

(30) Foreign Application Priority Data

Dec. 27, 2007 (JP) ..... 2007-335634

(51) Int. Cl.
*G03G 15/00* (2006.01)

(52) U.S. Cl. ..... 399/110; 399/125

(58) Field of Classification Search ..... 399/110, 399/124, 125

See application file for complete search history.

(56) References Cited

U.S. PATENT DOCUMENTS

| | | | | |
|---|---|---|---|---|
| 5,978,626 | A * | 11/1999 | Nagamine et al. | 399/125 |
| 6,038,417 | A | 3/2000 | Nagamine et al. | |
| 6,219,508 | B1 | 4/2001 | Nagatomi et al. | |

FOREIGN PATENT DOCUMENTS

| | | | |
|---|---|---|---|
| JP | 04-349470 | A | 12/1992 |
| JP | 05-278266 | | 10/1993 |
| JP | 08-179673 | A | 7/1996 |
| JP | 09-329931 | A | 12/1997 |
| JP | 11-153893 | | 6/1999 |
| JP | 11-338208 | A | 12/1999 |
| JP | 2004-354846 | A | 12/2004 |
| JP | 2005-214998 | A | 8/2005 |

OTHER PUBLICATIONS

JP Office Action dated Oct. 18, 2011, corresponding Application No. 2007-335634; English Translation.

JP Decision to Grant dated Dec. 13, 2011, corresponding JP Application No. 2007-335634; English Translation.

* cited by examiner

*Primary Examiner* — William J Royer
(74) *Attorney, Agent, or Firm* — Banner & Witcoff, Ltd.

(57) ABSTRACT

An image forming apparatus includes: a housing including a photosensitive member and having an opening at an upper portion of the housing; an upper cover connected to the housing at one end of the upper cover via a hinge and configured to move between an opened state and a closed state; an exposure unit supported by the upper cover and configured to face the photosensitive member when the upper cover is in the closed state; and a lock mechanism. The lock mechanism is releasable by lifting the upper cover so that the upper cover becomes to the opened state.

15 Claims, 8 Drawing Sheets

IMAGE FORMING APPARATUS HAVING A LOCK MECHANISM RELEASABLE BY LIFTING AN UPPER COVER

CROSS-REFERENCE TO RELATED APPLICATION

This application claims priority from Japanese Patent Application No. 2007-335634, filed on Dec. 27, 2007, the entire subject matter of which is incorporated herein by reference.

TECHNICAL FIELD

Aspects of the present invention relates to an image forming apparatus having an upper cover that opens and closes an opening of a main housing by vertical pivoting action.

BACKGROUND

In an image forming apparatus, LED heads that generate electrostatic latent images on respective photosensitive drums are held on a pivotable upper cover by way of holding members, and the LED heads move, along with pivoting action of the upper cover between exposure positions where the photosensitive drums are exposed and retracted positions separated from the photosensitive drums. For example, JP-A-11-153893 describes such image forming apparatus and a lock mechanism (an open-close mechanism) for an upper cover. In the image forming apparatus, the mechanism releases a lock member as a result of pressing of an unlock button provided on an upper surface of a main body of the apparatus so that the mechanism lifts the upper cover to a predetermined height by means of a strong spring. And then, the upper cover is manually pivoted.

However, with the lock mechanism as mentioned above, the user has to perform two operations, that is, operation on the unlock button and pivoting movement of the upper cover. Further, since the strong spring for use in lifting the upper cover to the predetermined height is provided, the main housing of the apparatus and the upper cover have to be reinforced in order to maintain a locked state (a state where the upper cover is closed).

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide an image forming apparatus that enables opening of an upper cover in one operation.

According to an exemplary embodiment of the present invention, there is provided an image forming apparatus including: a housing including a photosensitive member and having an opening at an upper portion of the housing; an upper cover connected to the housing at one end of the upper cover via a hinge and configured to move between an opened state in which the upper cover does not cover the opening and a closed state in which the upper cover covers the opening; an exposure unit supported by the upper cover and configured to face the photosensitive member when the upper cover is in the closed state; and a lock mechanism. The lock mechanism is releasable by lifting the upper cover so that the upper cover becomes to the opened state.

According to another exemplary embodiment of the present invention, there is provided an image forming apparatus including: a housing including a photosensitive member and having an opening at an upper portion of the housing; an upper cover connected to the housing at one end of the upper cover via a hinge and configured to move between an opened state in which the upper cover does not close the opening and a closed state in which the upper cover closes the opening; an exposure unit supported by the upper cover and configured to face the photosensitive member when the upper cover is in the closed state; and a lock mechanism. The lock mechanism includes a first lock member which is provided to the upper cover; a second lock member which is provided to the housing; and an urging member which urges the first lock member to the second lock member so that the first lock member and the second lock member are engaged with each other when the upper cover is in the closed state. When the upper cover is lifted from the closed state to the opened state, the first lock member is slidably contact with the second lock member so that the engagement between the first lock member and the second lock member is released.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Figure 1:
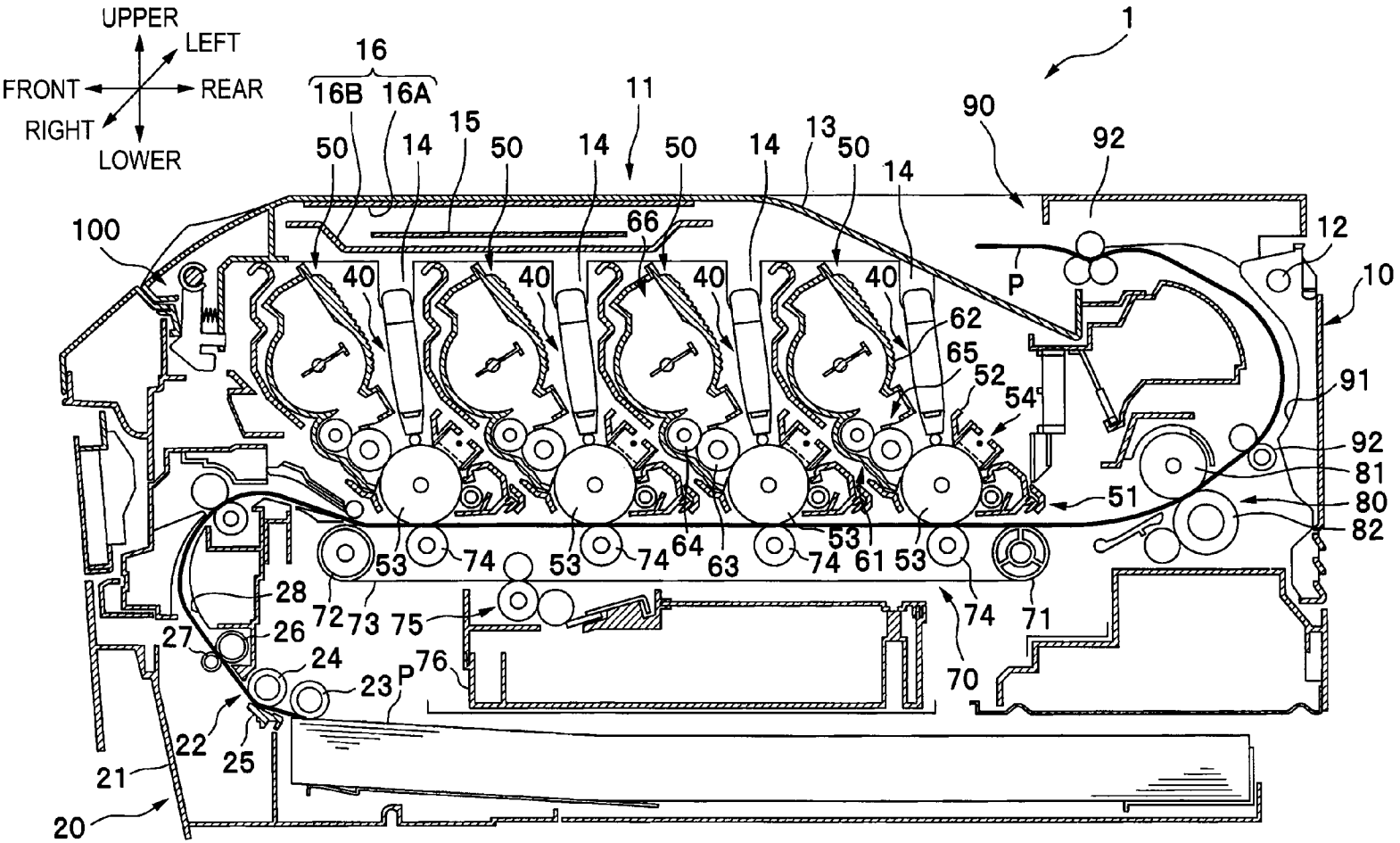
FIG. 1 is a cross-sectional view showing the overall configuration of a color printer according to an exemplary embodiment.
Figure 2:
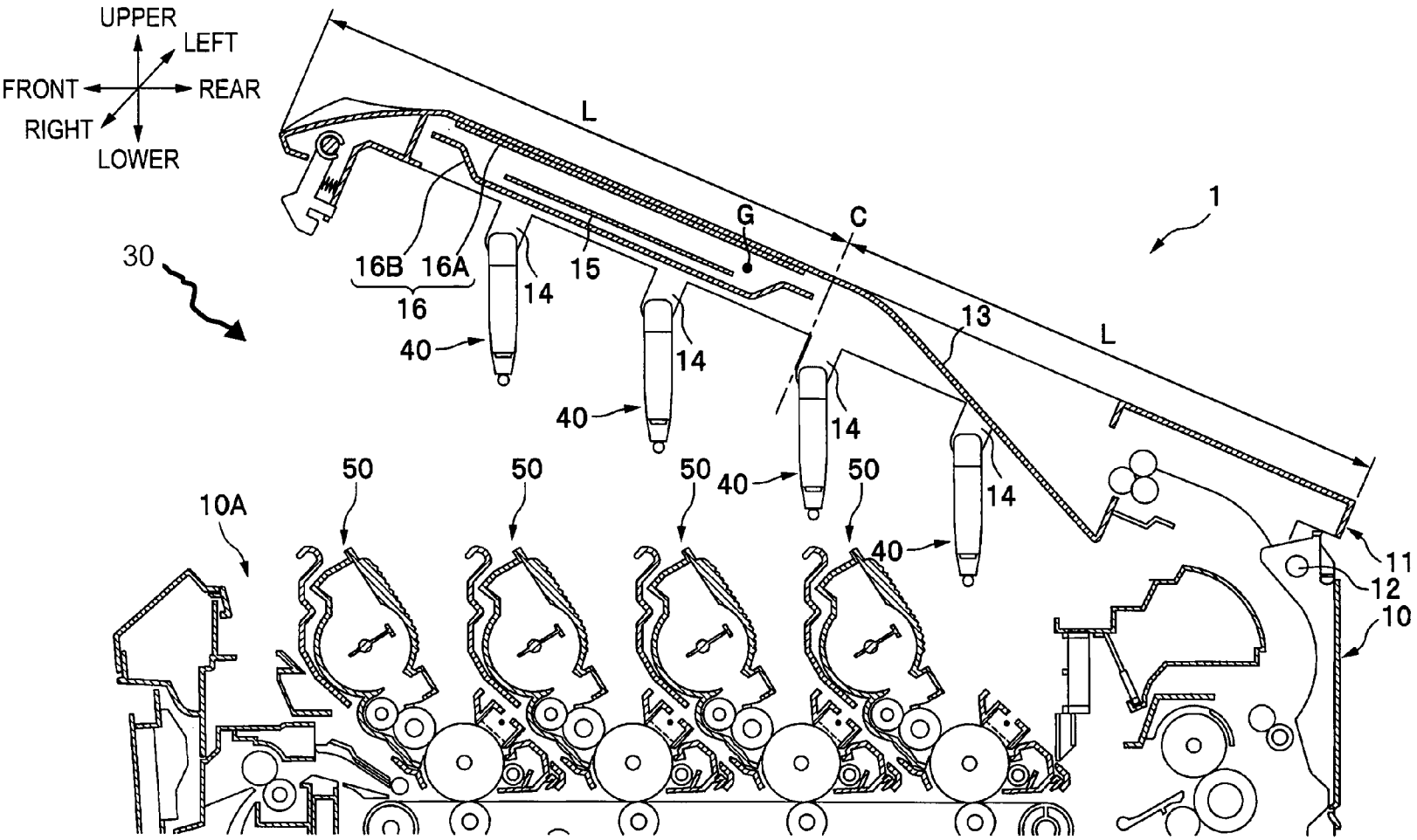
FIG. 2 is a cross-sectional view showing the color printer in which an upper cover is opened.
Figure 3:
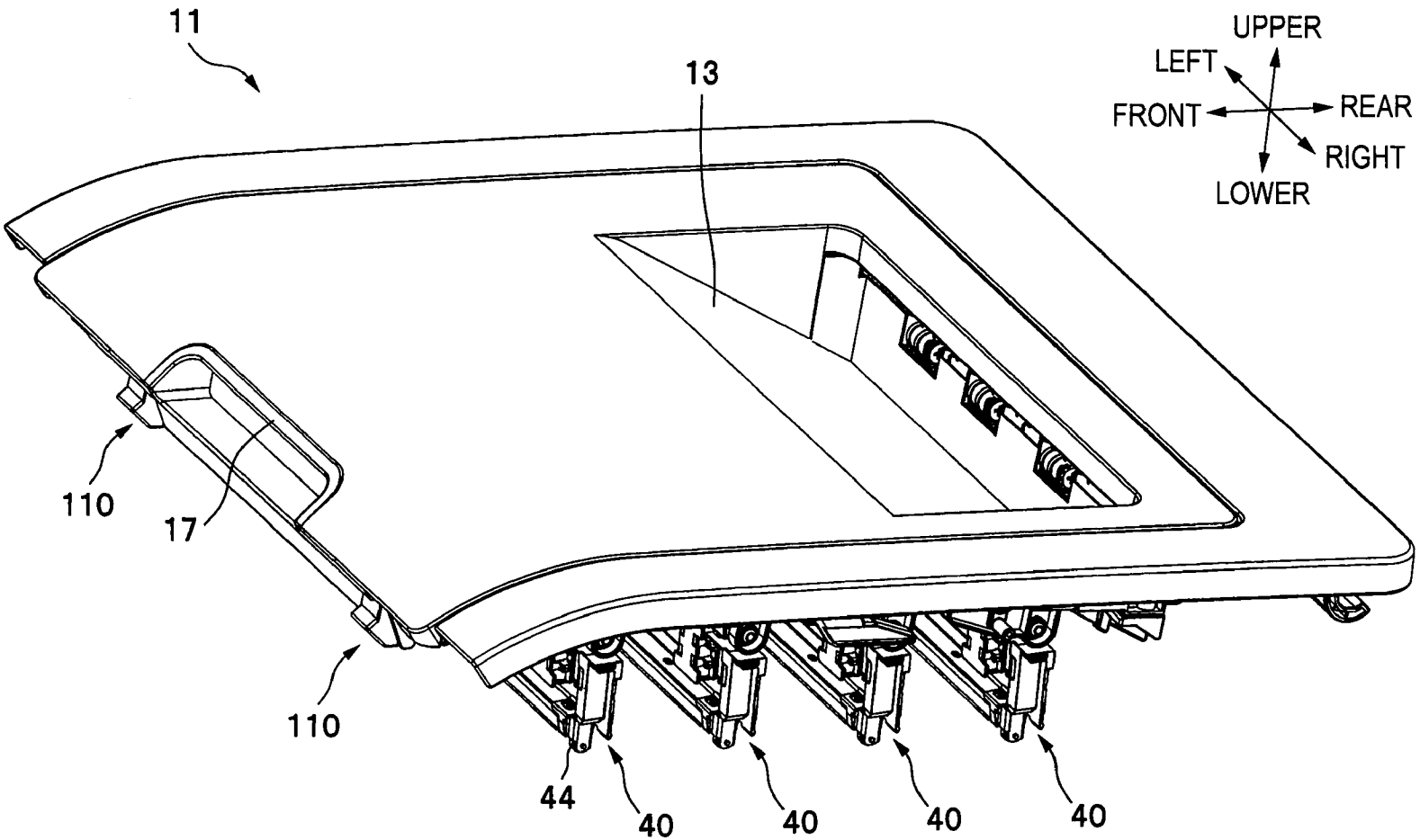
FIG. 3 is a perspective view of the upper cover.
Figure 4:
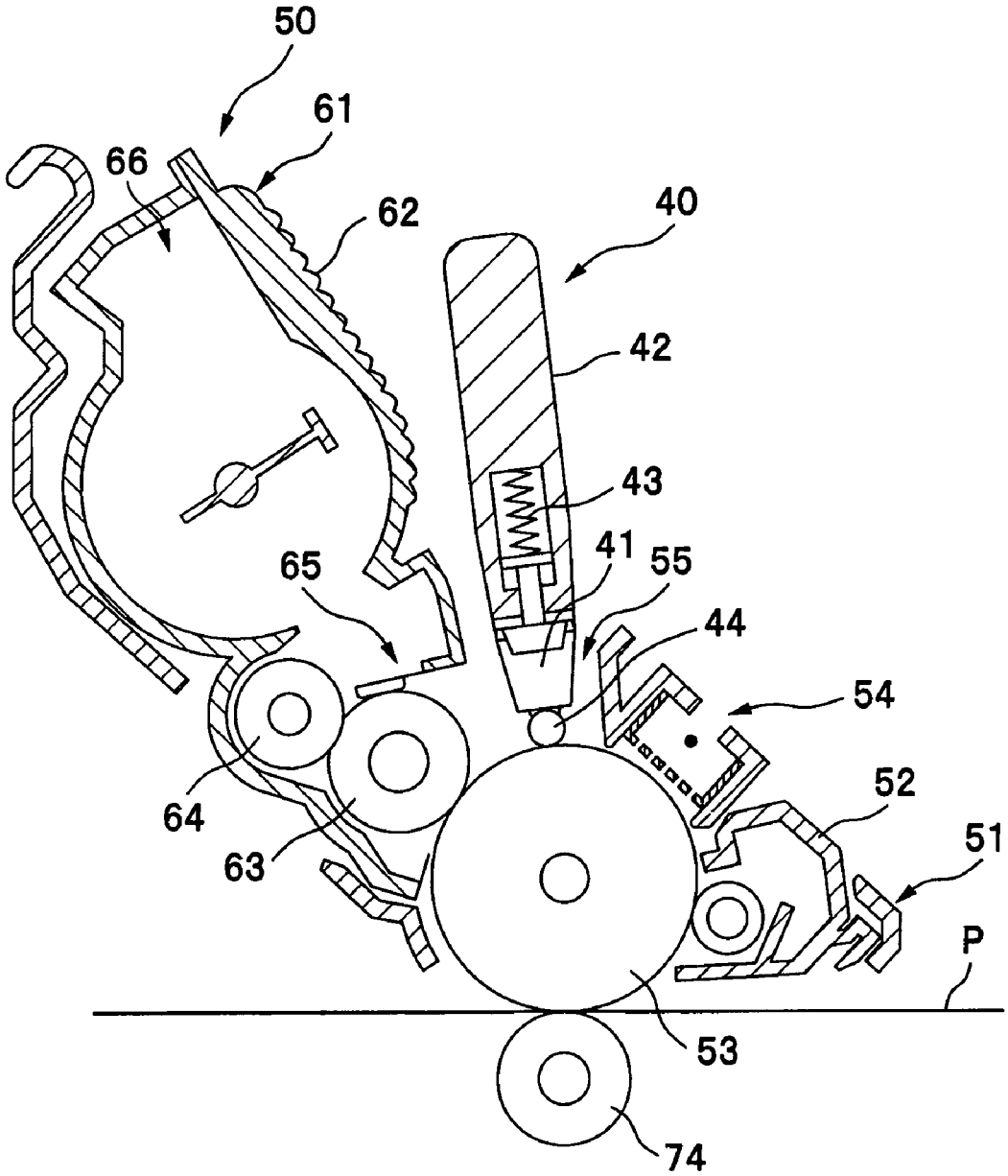
FIG. 4 is a cross-sectional view showing the configuration of a process cartridge and the configuration of an LED unit.

An exemplary embodiment of the present invention will now be described in detail with reference to the drawings. In the drawings, FIG. 1 is a cross-sectional view showing the overall configuration of a color printer; FIG. 2 is a cross-sectional view showing the color printer in which an upper cover is opened; FIG. 3 is a perspective view of the upper cover; and FIG. 4 is a cross-sectional view showing the configuration of a process cartridge and an LED unit.

In the following, the description will be made with reference to user's directions in use of the printer. Specifically, in FIG. 1, the left side of the sheet is taken as "front"; the right side of the sheet is taken as "rear"; a direction away from the viewer in the sheet is taken as "left"; and a direction toward the viewer in the sheet is taken as "right." The vertical direction of the sheet is taken as the "upper and lower direction."

As shown in FIG. 1, a color printer 1 has, within a main housing 10, a sheet feeding section 20 for feeding a sheet P; an image forming section 30 for forming an image on the fed sheet P; and a sheet discharging section 90 that discharges the sheet P on which an image is formed. The main housing 10 has an opening 10A at an upper portion thereof. As shown in FIG. 2, an upper cover 11 for opening and closing the opening 10A of the main housing 10 is provided. The upper cover 11 is connected to the main housing 10 at a rear end of the upper cover 11 via a hinge. The hinge is configured by the rear end of the upper cover 11 and a rotary shaft 12 provided at a rear side of the main housing 10. The upper cover 11 is configured to pivot about the rotary shaft 12 in the upper and lower direction to move between an opened state in which the opening 10A is opened and a closed state in which the upper cover 11 closes the opening 10A.

As shown in FIG. 1, the upper surface of an upper cover 11 constitutes a sheet discharging tray 13 on which the sheets P discharged from the main housing 10 are stacked. A lower surface of the upper cover 11 is provided with a plurality of holding members 14 that hold (support) LED units 40, respectively. A control circuit (control substrate) 15 and a shield plate (sheet-metal member) 16 facing the control circuit 15 are provided inside of the upper cover 11. Further, as shown in FIG. 3, a recessed grip 17, which is gripped mainly when the upper cover 11 is opened, is provided at the center of a front edge of the upper cover 11.

As shown in FIG. 1, a lock mechanism 100 is provided at a front upper portion of the main housing 10 and a front end of the upper cover 11, respectively. The upper cover 11 is maintained in the closed state when the lock mechanism 100 is in a locked state. The lock of lock mechanism 100 is released into a released state by gripping the grip 17 and lifting of the upper cover 11 so that the upper cover 11 becomes into the opened state. A detailed configuration of the lock mechanism 100 will be described later.

By a related-art technique, the control circuit 15 outputs signals to respective LEDs of LED heads 41, to be described later, on the basis of data pertaining to an image to be generated, to thus control light emission of the LEDs.

The shield plate 16 is a plate material made of metal and shields the control circuit 15 from noise arising outside of the control circuit 15. As shown in FIG. 1, the shield plate 16 includes an upper shield plate 16A disposed in the front side of the upper cover 11 and that opposes an upper surface of the control circuit 15; and a lower shield plate 16B that opposes a lower surface of the control circuit 15. The shield plate 16 acts as a reinforcement member and contributes to enhancement of strength of the upper cover 11.

As shown in FIG. 2, the control circuit 15 and the shield plate 16 are disposed at the front interior side of the upper cover 11 so that the centroid G of the upper cover 11 is positioned at more front than the center C located at an equidistance L from the front end and the rear end of the upper cover 11. In other words, the centroid G of the upper cover 11 is positioned between the front end thereof and the center C thereof. The centroid of the control circuit 15 and the centroid of the shield plate 16 are also positioned at more front than the center C of the upper cover 11 shown in FIG. 2. Further, the control circuit 15 is arranged at a position closer to the grip 17 than to the hinge.

As shown in FIG. 1, the sheet feeding section 20 includes a sheet feeding tray 21 that is provided in a lower inner portion of the main housing 10 and that is removably attached to the main housing 10; and a sheet feeding mechanism 22 that conveys the sheets P from the sheet feeding tray 21 to the image forming section 30. The sheet feeding mechanism 22 is provided on the right side of the sheet feeding tray 21 and includes a feed roller 23, a separation roller 24, and a separation pad 25.

In the sheet feeding section 20 configured as mentioned above, the sheets P mounted in the sheet feeding tray 21 are separated one at a time and fed upwardly. After sheet powder is removed during the course of the sheet passing between a sheet powder removal roller 26 and a pinch roller 27, the sheet passes through a conveyance path 28, to thus be turned back and fed to the image forming section 30.

The image forming section 30 includes the four LED units 40; four process cartridges 50; a transfer unit 70; and a fixing unit 80.

The LED units 40 are disposed above photosensitive drums 53, respectively. As shown in FIG. 4, each of the LED units 40 includes an LED head 41; a frame 42; a coil spring 43; and a guide roller 44. The LED heads 41 are configured to be disposed opposite (facing) the photosensitive drums 53, respectively.

A plurality of light-emitting diodes (LEDs, not shown) is arranged in a horizontal direction on the surface of the LED head 41 while opposing (facing) the photosensitive drum 53. Upon receipt of a signal from the control circuit 15, each of the LEDs illuminates based on the data pertaining to an image to be formed, thereby exposing the surface of the photosensitive drum 53.

The frame 42 covers the LED head 41. A lower portion of a back plate is formed in a concave. An upper end of the LED head 41 is inserted into the concave. Thus, the LED head 41 is slidable in the vertical direction with respect to the frame 42. The coil spring 43 is interposed between the frame 42 and the LED head 41. The frame 42 is pivotally supported by the upper cover 11 through a holding member 14. As a result, the LED unit 40 (the LED head 41) is movable between a retracted position and an exposure position where the LED unit 40 opposes the photosensitive drum 53 by upwardly pivoting the upper cover 11 (see FIG. 2).

When the LED head 41 is positioned at the exposure position, the guide rollers 44 roll over the surface of the photosensitive drum 53 while contacting therewith, thereby regulating an interval between the LED head 41 and the photosensitive drum 53. The guide rollers 44 are provided at both horizontal ends of a tip portion of the LED head 41 and located outside of a range of the surface of the photosensitive drum 53 where an electrostatic latent image is to be formed (see FIG. 3).

When the LED head 41 is positioned at the exposure position, namely, in a state where the upper cover 11 is closed, the guide rollers 44 are brought into contact with the surface of the photosensitive drum 53, whereby coil springs 43 are compressed between the LED head 41 and the frame 42, so that the LED head 41 is urged toward the photosensitive drum 53.

The process cartridges 50 are aligned in a longitudinal direction between the upper cover 11 and the sheet feeding section 20 (see FIG. 1). Each of the process cartridges 50 has a drum unit 51 and a developing unit 61 removably attached to the drum unit 51. The process cartridges 50 can be replaced through the opening 10A of the main housing 10 after the upper cover 11 is pivoted upwardly (see FIG. 2). The process cartridges 50 differ from each other only in the color of toner (a developing agent) housed in a toner housing chamber 66 of a developing unit 61 and are identical with each other in a structure.

Each of the drum units 51 includes a drum case 52; a photosensitive drum 53 rotatably supported by the drum case 52; and an electrifier 54.

As a result of the developing unit 61 being attached to the drum case 52, an exposure space 55 (see FIG. 4) through which the photosensitive drum 53 is viewed from the outside is defined. The LED unit 40 (the LED head 41) is inserted into the exposure space 55 so as to oppose an upper area of the surface of the photosensitive drum 53.

The developing unit 61 has a case 62; a developing roller 63 and a supply roller 64 that are rotatably supported by the case 62; and a blade assembly 65. Further, the developing unit 61 has the toner housing chamber 66 that houses toner.

As shown in FIG. 1, the transfer unit 70 is interposed between the sheet feeding section 20 and the respective process cartridges 50. The transfer unit 70 includes a drive roller 71, a driven roller 72, a conveyance belt 73, transfer rollers 74, and a cleaning section 75.

The drive roller 71 and the driven roller 72 are provided in parallel while being spaced apart from each other in the longitudinal direction. The conveyance belt 73 formed from an endless belt is wound around the drive roller 71 and the driven roller 72. An external surface of the conveyance belt 73 is in contact with the respective photosensitive drums 53. Four transfer rollers 74 that nip the conveyance belt 73 in conjunction with the respective photosensitive drums 53 are disposed inside of the conveyance belt 73 so as to oppose the respective photosensitive drums 53. A transfer bias voltage is applied to the transfer rollers 74 by constant current control operation performed during transfer.

The cleaning section 75 is disposed below the conveyance belt 73 and configured so as to remove the toner adhering to the conveyance belt 73 and cause the thus-removed toner to fall into a toner reservoir section 76 disposed below the cleaning section 75.

The fixing unit 80 is disposed at the rear of the respective process cartridges 50 and the transfer unit 70 and includes a heating roller 81 and a pressing roller 82 that is disposed opposite the heating roller 81 and presses the heating roller 81.

In the image forming section 30 configured as mentioned above, surfaces of the respective photosensitive drums 53 are uniformly charged by the electrifiers 54 and subsequently exposed by LED light emitted from the respective LED heads 41. Thereby, the electric potential of exposed areas becomes lower, and electrostatic latent images based on image data are formed on the respective photosensitive drums 53.

The toner in the toner housing chamber 66 is supplied to the developing roller 63 by rotation of the supply roller 64, and the thus-supplied toner enters a space between the developing roller 63 and the blade assembly 65 by rotation of the developing roller 63, whereupon the toner is held on the developing roller 63 as a thin layer of specific thickness.

The toner held on the developing roller 63 is supplied to the electrostatic latent image formed on the photosensitive drum 53 when the developing roller 63 contacts the photosensitive drum 53 in an opposing manner. Thereby, the toner is selectively held on the photosensitive drum 53, so that the electrostatic latent image is visualized and that a toner image is formed by this reversal development.

In the course of the sheet P fed on the conveyance belt 73 passing between the respective photosensitive drums 53 and the respective transfer rollers 74 disposed inside of the conveyance belt 73, the toner images formed on the respective photosensitive drums 53 are sequentially transferred to the sheet P. When the sheet P passes between the heating roller 81 and the pressing roller 82, the toner images transferred onto the sheet P are thermally fixed.

The sheet discharging section 90 includes a sheet discharging path 91 that is formed so as to upwardly extend from an exit of the fixing unit 80 and turn to the right side and a plurality of conveyance roller pairs 92 for conveying the sheet P. The sheet P on which the toner images are transferred and thermally fixed is conveyed along the discharging path 91 by the conveyance rollers 92, discharged to the outside of the main housing 10, and stacked on the sheet discharging tray 13.

Figure 5:
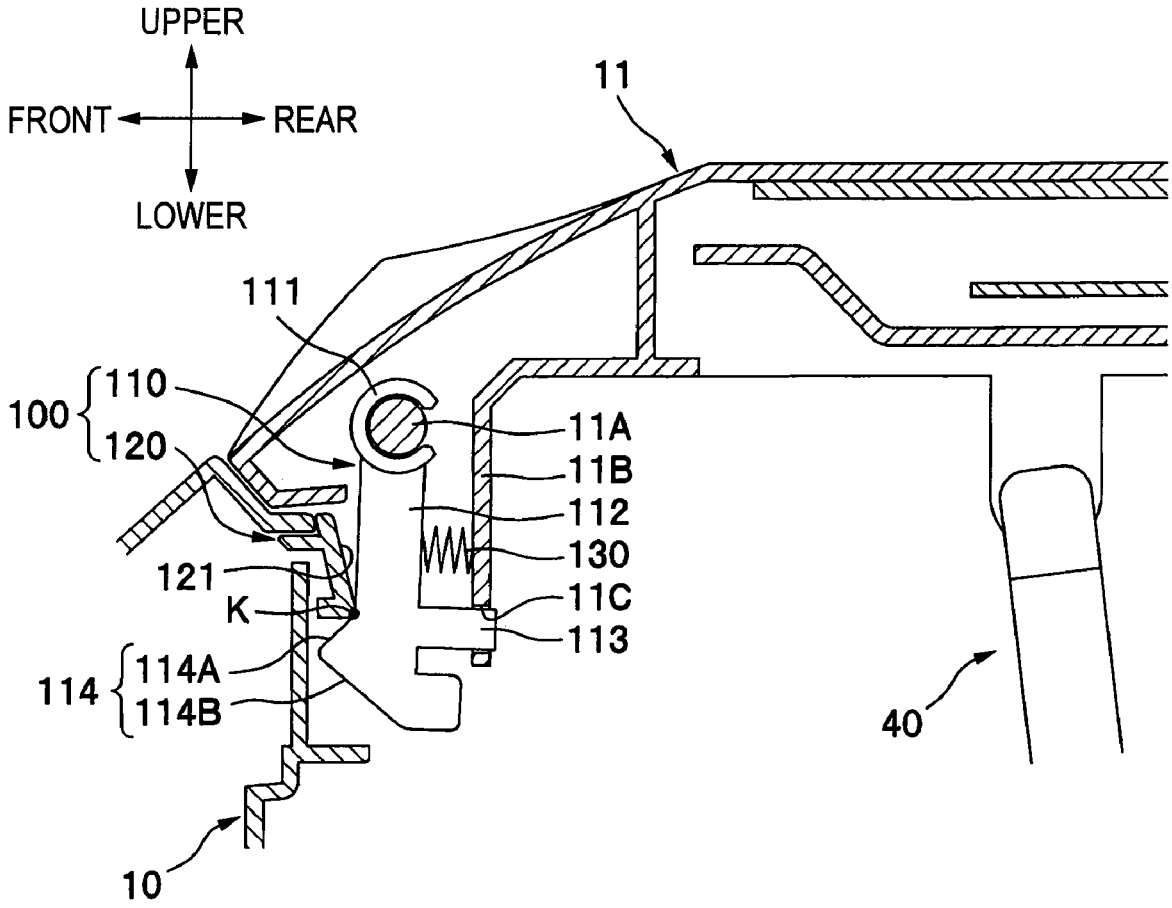
FIG. 5 is an enlarged view showing the configuration of a lock mechanism according to an exemplary embodiment.

FIG. 5 is an enlarged view showing the configuration of the lock mechanism 100.

As shown in FIG. 5, the lock mechanism 100 has an engagement protrusion 110 provided at a front end of the upper cover 11; a latch claw 120 provided at a front upper portion of the main housing 10; and a coil spring 130.

The engagement protrusion 110 is provided at each end of the grip 17 at the front end of the upper cover 11 (see FIG. 3). Each of the engagement protrusions 110 includes a shaft engagement section 111, an arm 112, a pivotal movement regulation section 113, and a protrusion section 114, all of which are formed integrally.

The shaft engagement section 111 is formed into a substantially C-shape when viewed from the side and engages with a substantially cylindrical pivotal shaft 11A provided to the upper cover 11. Accordingly, the engagement protrusion 110 is supported by the upper cover 11 pivotably in a direction in which the engagement protrusion 110 approaches or separates from the latch claw 120, that is, in the longitudinal direction.

The arm 112 extends downwardly from the shaft engagement section 111 and couples the shaft engagement section 111 to the pivotal movement regulation section 113 and the protrusion section 114. A support wall 11B extending from the upper cover 11 is provided at the rear of the arm 112, and the coil spring 130 is interposed between the support wall 11B and the arm 112.

The pivotal movement regulation section 113 extends from the arm 112 in a rearward direction at a position below the coil spring 130 and loosely fits into a through hole 11C opened in the support wall 11B of the upper cover 11. Thereby, the engagement protrusion 110 longitudinally pivots without deviating in the left and right direction.

Each of the protrusion sections 114 protrudes from a front lower portion of the arm 112 to the front so as to have a tapered shape when viewed from the side. Specifically, each protrusion section 114 includes an upper slope 114A that tilts upwardly from the front to the rear and a lower slope 114B that tilts downwardly from the front to the back. An upper end of the upper slope 114A acts as an engagement point K that engages with the latch claw 120 when the upper cover 11 is closed.

Two of the latch claws 120 are provided at a front upper portion of the main housing 10 correspondingly to the engagement protrusions 110 of the upper cover 11. Each latch claw 120 includes a slope 121 that downwardly tilts from the front to the rear. A lower end of the slope 121 acts as the engagement point K that engages with the engagement protrusion 110 when the upper cover 11 is closed. In FIG. 5, the latch claws 120 are provided as members separate from the main housing 10 but may also be formed integrally with the main housing 10.

The coil spring 130 is interposed between the arm 112 of the engagement protrusion 110 and the support wall 11B of the upper cover 11 as mentioned above. The coil spring 130 is compressed by the arm 112 in the state shown in FIG. 5;

namely, the state where the upper cover 11 is closed. Thereby, the engagement protrusion 110 is urged in a direction (forward direction) in which the protrusion approaches the latch claw 120.

Figure 6:
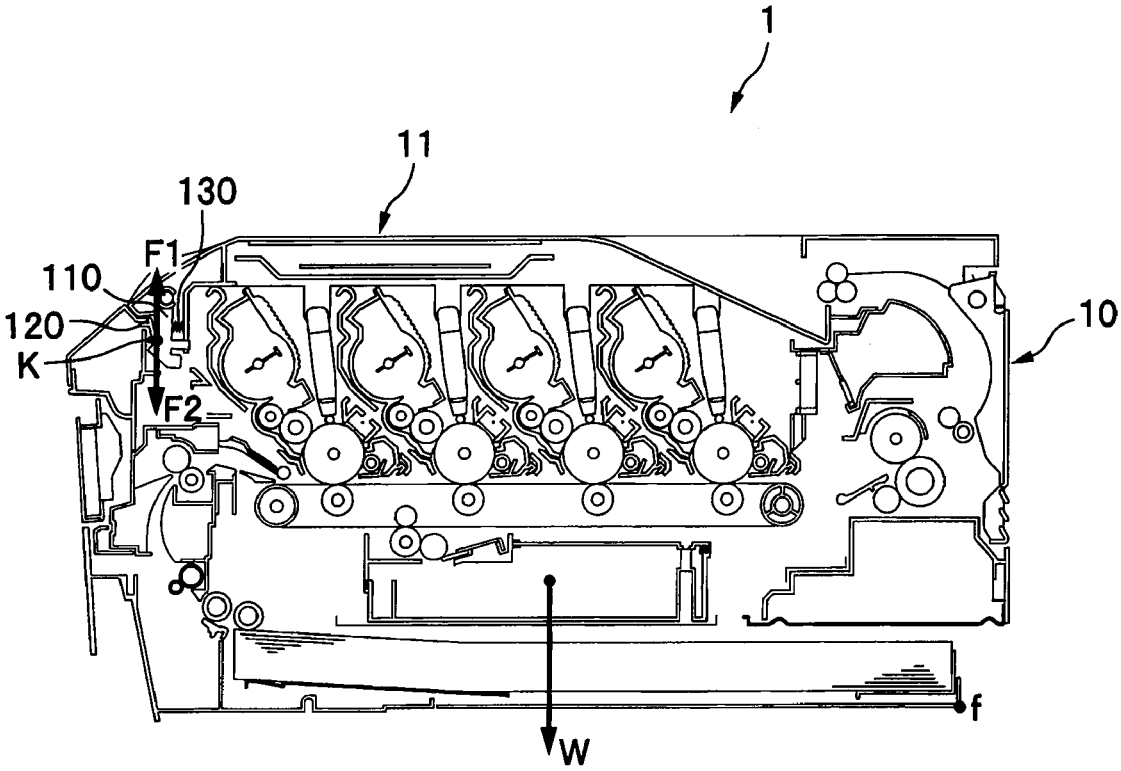
FIG. 6 is a view showing force acting on an engagement point when the upper cover is being opened.
Figure 7A:
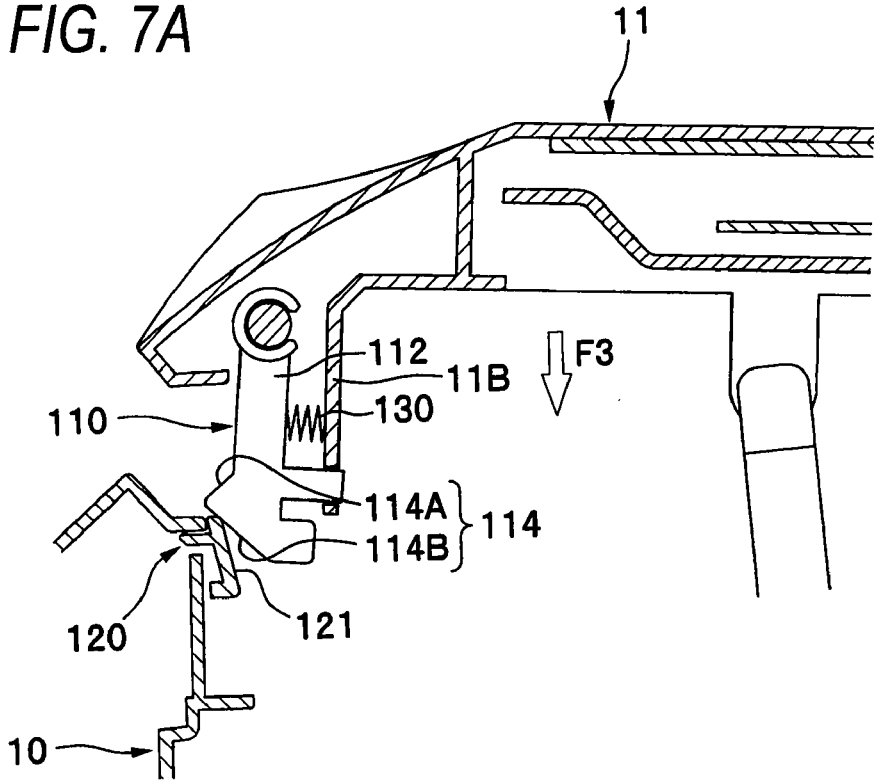
FIG. 7A is a view showing the upper cover before the upper cover is closed.
Figure 7B:
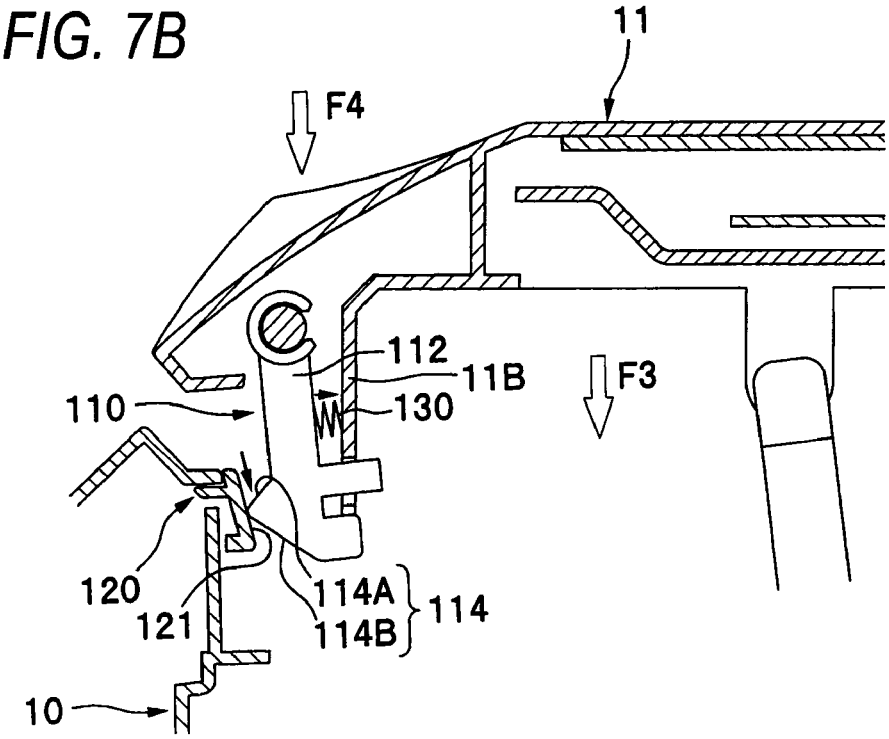
FIG. 7B is a view showing the upper cover in the course of being closed.
Figure 8:
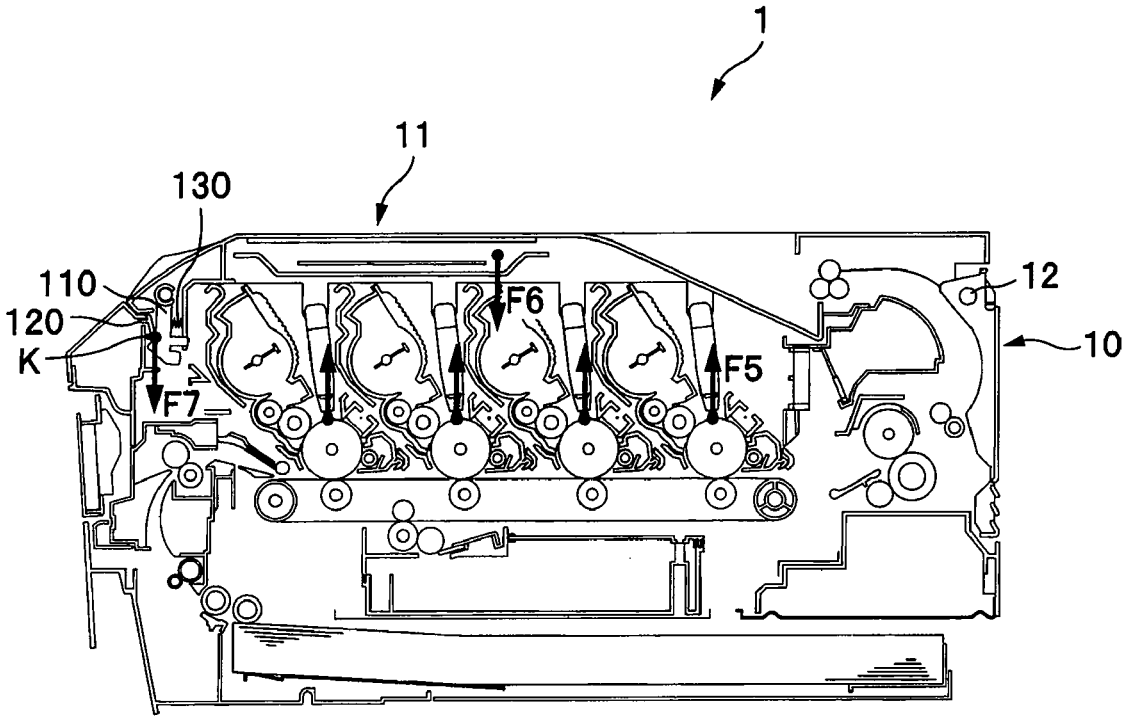
FIG. 8 is a view showing force acting on the upper cover in a closed state.

The operations of the color printer 1 configured as mentioned above will now be described. FIG. 6 is a view showing force acting on the engagement point K when the upper cover 11 is being opened. FIG. 7A is a view showing the upper cover 11 before being closed; and FIG. 7B is a view showing the upper cover 11 in the course of being closed. FIG. 8 is a view showing force acting on the closed upper cover 11.

First, the force acting on the lock mechanism 100 when the upper cover 11 is being opened and operation of the lock mechanism 100 performed when the upper cover 11 is being opened will be described.

When the grip 17 (see FIG. 3) of the upper cover 11 is gripped and the front side of the upper cover 11 is pulled up, upward force F1 for lifting the color printer 1 acts on the engagement point K of the upper cover 11 as shown in FIG. 6. Further, downward force F2 acts on the engagement point K. The downward force F2 is generated due to gravity force of the color printer 1 as counterforce to the force F1 so as to maintain the color printer 1 at the current position.

The maximum value of the downward force F2 for maintaining the color printer 1 at the current position is determined by the weight W of the color printer 1 except the upper cover 11 and components attached to the upper cover 11. Specifically, the maximum value corresponds to force achieved if a coil spring which does not elastically deform would be arranged in place of the coil spring 130 and if the upper cover 11 would be pulled up and the color printer 1 would be pivotably lifted about fulcrum "f" as a pivotal center.

In the meantime, the maximum value of the upward force F1 for lifting the color printer 1 is determined by engagement force between the engagement protrusions 110 and the latch claws 120. The engagement force occurring between the engagement protrusions 110 and the latch claws 120 corresponds to vertical force that acts on engagement points between the engagement protrusions 110 and the latch claws 120 as a result of lifting of the upper cover 11. Specifically, the engagement force is force that upwardly acts on the lower ends of the slopes 121 of the latch claws 120 provided on the main housing 10 from the upper ends of upper slopes 114A of the engagement protrusions 110 provided on the upper cover 11 when the upper cover 11 is lifted. The force F1 is generated as a result of the coil springs 130 urging the engagement protrusions 110 in the direction in which the protrusions approach the latch claws 120. Hence, the maximum value of the force F1 is determined by the urging force of the coil springs 130.

In the present exemplary embodiment, the urging force of the coil springs 130 is set so that the maximum value of the force F1 is smaller than the maximum value of the force F2. As a result, when the force F1 exceeds the maximum value, the upper slopes 114A of the engagement protrusions 110 shown in FIG. 5 start upwardly sliding along the lower ends of the slopes 121 of the latch claws 120, whereupon the engagement protrusions 110 start moving upwardly. At this time, the coil springs 130 are compressed by the arms 112 of the engagement protrusions 110. In a state where the lower ends (the apexes of the protrusion sections 114) of the upper slopes 114A have passed by the lower ends of the slopes 121, the engagement (lock) of the engagement protrusions 110 with the latch claws 120 is released. Hence, the upper cover 11 is capable of pivoting in an upward direction as shown in FIG. 2.

In other words, in the present exemplary embodiment, the force F1 for lifting the color printer 1 acts on the engagement point K of the upper cover 11 when the grip 17 is lifted up. This force F1 has a component for rotating the color printer 1 in the clockwise direction around the fulcrum f. The gravity force due to the weight W of the color printer 1 except the upper cover 11 and components attached to the upper cover 11 acts on the centroid G of the color printer 1. The gravity force due to the weight W of the color printer 1 has a component for rotating the color printer 1 in the counterclockwise direction. In order to release the engagement (lock) between the engagement protrusions 110 and the latch claws 120 before the color printer 1 is lifted up, it is necessary to set the force F1 so that a component of the force F1 for rotating the color printer 1 in the clockwise direction is smaller than a component of the gravity force due to the weight W of the color printer 1 for rotating the color printer 1 in the counterclockwise direction According to the exemplary present embodiment, the engagement (lock) between the engagement protrusions 110 and the latch claws 120 is released by lifting the upper cover 11 as mentioned above, and hence the upper cover 11 can be opened in single operation; namely, lifting of the upper cover 11. Additionally, the force required at the time of opening and closing the upper cover 11 can be readily adjusted by changing the urging force of the coil springs 130. In the exemplary present embodiment, since the grip 17 (see FIG. 3) is provided at the center of the front edge remote from the rotary shaft 12, the upper cover 11 can be lifted by comparatively smaller force than that required when the grip 17 is provided at a position closer to the rotary shaft 12.

Further, in the present exemplary embodiment, even when the force F1 exceeds the maximum value, the force F2 that is counterforce to the force F1 does not reach the maximum value. Therefore, the upper cover 11 can be opened while the color printer 1 maintains its current position; namely, while the main housing 10 is not lifted and maintains its stationary state.

In other words, when the upper cover 11 is opened, clockwise moment generated around the fulcrum "f" by the force F1 becomes smaller than counterclockwise moment generated around the fulcrum "f" by the weight W of the color printer 1 except the upper cover 11 and members attached thereto. Therefore, the main housing 10 is not lifted and can maintain its stationary state.

In the case where the maximum value of the force F1 is greater than the maximum value of the force F2, the coil springs 130 are not sufficiently compressed even when the force F2 exceeds the maximum value. Therefore, the engagement (lock) between the engagement protrusions 110 and the latch claws 120 is not released, and the force F1 becomes greater in accordance with the force used for lifting the upper cover 11. Therefore, the color printer 1 is lifted about the fulcrum "f" as the pivotal center.

The force acting on the lock mechanism 100 when the upper cover 11 is being closed and operation of the lock mechanism 100 performed when the upper cover 11 is being closed will now be described.

In the stationary state shown in FIG. 7A, downward force F3 due to weight of the upper cover 11 acts on the upper cover 11. At this time, the protrusion sections 114 of the engagement protrusions 110 (the lower slopes 114B) come to standstill while remaining in contact with the upper ends of the slopes 121 of the latch claws 120. Specifically, the urging force of the coil springs 130 is set so that the coil springs 130 are not sufficiently compressed when only the downward force F3 due to the weight of the upper cover 11 acts on the upper cover 11.

When the downward force F4 for closing the upper cover 11 additionally acts on the upper cover 11 in this state, the lower slopes 114B start downwardly sliding over the upper ends of the slopes 121, whereupon the engagement protrusions 110 start moving downwardly. At this time, the coil springs 130 are further compressed by the arms 112 of the engagement protrusions 110. Moreover, as shown in FIG. 7B, the upper ends (the apexes of the protrusion section 114) of the lower slopes 114B slide over the slopes 121, whereby the engagement protrusions 110 move further downwardly. In association with such downward movement, the coils springs 130 are further compressed by the arms 112 of the engagement protrusions 110.

When upper ends (the apexes of the protrusion section 114) of the lower slopes 114B pass by the lower ends of the slopes 121, the upper slopes 114A downwardly slide over the lower ends of the slopes 121, and the engagement protrusions 110 move further downwardly. At this time, the engagement protrusions 110 are pressed by the coil springs 130, to be urged toward the latch claws 120 (to the front). As shown in FIG. 5, the upper ends of the upper slopes 114A come into contact with the lower ends of the slopes 121, whereby the engagement protrusions 110 engage with the latch claws 120, whereby the upper cover 11 is maintained in a closed state.

As mentioned above, in the present exemplary embodiment, the downward force F4 is exerted on the upper cover 11; namely, when downward force (F3+F4) exceeding the downward force F3 due to the weight of the upper cover 11 is exerted on the upper cover 11, the coil springs 130 are compressed, and the upper cover 11 can be finally closed. In other words, when the downward force F4 is not exerted on the upper cover 11; namely, when only the downward force F3 due to the weight of the upper cover 11 is exerted on the upper cover 11, the upper cover 11 is not closed. Therefore, the user's finger can be prevented from being pinched between the main housing 10 and the upper cover 11.

Next, the force acting on the closed upper cover 11 will be described.

As shown in FIG. 8, when the guide rollers 44 come into contact with the surfaces of the photosensitive drums 53, the coil springs 43 located between the LED heads 41 and the frame 42 are compressed, thereby generating upward force F5. The force F5 acts on the closed upper cover 11. The force F5 acts in a direction in which the upper cover 11 is opened. The force F5 is a sum of four upward forces generated as a result of compression of the four coil springs 43.

The force resistant to the force F5, that is, the force acting in the direction in which the upper cover 11 is closed includes downward force F6 due to the weight of the upper cover 11 and engagement force F7 that is generated by the engagement protrusions 110 and the latch claws 120 and that downwardly acts in response to the upward force (mainly a difference between the force F5 and the force F6 (F5−F6)). The engagement force occurs between the engagement protrusions 110 and the latch claws 120 in this case are forces that downwardly act on the upper ends of the upper slopes 114A of the engagement protrusions 110 provided on the upper cover 11 from the lower ends of the slopes 121 of the latch claws 120 provided on the main housing 10. The engagement force F7 is a force that arises as a result of the coil springs 130 urging the engagement protrusions 110 in the direction approaching the latch claws 120.

In the present exemplary embodiment, a sum of the maximum value of the engagement force F7 occurring between the engagement protrusions 110 and the latch claws 120 and the downward force F6 due to the weight of the upper cover 11 is set so as to be greater than the maximum value of the force F5. As a result, in the state where the upper cover 11 is closed, the force acting in the direction in which the upper cover 11 is opened (that is, the working force F5, and in this case the maximum value is achieved because the coil springs 43 are compressed to the maximum) becomes equal to the force acting in the direction in which the upper cover 11 is closed (the force F6+the engagement force F7), and hence the upper cover 11 can be maintained in the closed state.

In other words, the sum of the counterclockwise moment generated around the rotary shaft 12 by the force F6 and the counterclockwise moment generated around the rotary shaft 12 by the engagement force F7 becomes equal to the clockwise moment generated around the rotary shaft 12 by the force F5, and therefore, the upper cover 11 can be maintained in the closed state.

Even when upward force is exerted on the upper cover 11, a sum of the maximum value of the engagement force F7 and the force F6 is greater than the force F5 (since the coil springs 43 slightly expand in this case, the sum might become a value that is smaller than the maximum value), the upper cover 11 can be maintained in the closed state. Specifically, when the upper cover 11 is lifted, the upper cover 11 is maintained in the closed state unless the engagement force F7 reaches the maximum value. As the force for lifting the upper cover 11 is increased, the coil springs 130 are compressed, whereupon the engagement force F7 increases. When the engagement force F7 reaches the maximum value, the engagement (lock) between the engagement protrusions 110 and the latch claws 120 are released, so that the upper cover 11 can be opened.

In the present exemplary embodiment, the centroid G of the upper cover 11 is positioned at more front than the center C of the upper cover 11 shown in FIG. 2. Therefore, when compared with the case where the centroid G is positioned more rear than the center C, the force F4 required at the time of closing of the upper cover 11 (see FIG. 7B) becomes smaller, and the coil springs 130 that generate smaller urging force can be employed. As a result of the force F4 required at the time of closing of the upper cover 11 being made smaller, the upper cover 11 can be readily closed. Further, use of the coil springs 130 that generate smaller urging force results in a reduction in the force required at the time of opening of the upper cover 11. Accordingly, stability of the color printer 1 can be enhanced.

Since the control circuit 15 and the shield plate 16 are arranged so that the centroid G of the upper cover 11 is positioned more front than the center C, the control circuit 15 and the shield plate 16 made of metal act as weights, thereby contributing to the upper cover 11 maintained in the closed state. Moreover, the control circuit 15 and the shield plate 16 act as weights, whereby the force F4 required at the time of closing of the upper cover 11 can be made small. Accordingly, the upper cover 11 can be readily closed.

While the present invention has been shown and described with reference to certain exemplary embodiments thereof, it will be understood by those skilled in the art that various changes in form and details may be made therein without departing from the spirit and scope of the invention as defined by the appended claims.

Although the exemplary embodiment provides the case where the engagement protrusions 110 are provided on the upper cover 11 and where the latch claws 120 are provided on the main housing 10, the inventive concept of the present invention is not limited to the exemplary embodiment. For example, the engagement protrusions 110 may be provided on the main housing 10 and in which the latch claws 120 may be provided on an upper cover 11.

The exemplary embodiment provides the case where the LED heads 41 using LEDs are adopted for exposing the photosensitive drum 53. However, the inventive concept of the present invention is not limited to the LEDs. For example, exposure portions using OLED (Organic Light Emitting Diode), fluorescent substances, or the like, may also be adopted in place of the LEDs. Moreover, there may also be adopted an exposure member that includes a plurality of optical shutters (e.g., liquid-crystal elements, PLZT elements, and the like) arranged for controlling light from a single or a plurality of light sources and that selectively controls an opening and closing time of the optical shutters on the basis of image data.

Although the exemplary embodiment provides the configuration in which the control circuit 15 and the shield plate 16 are arranged on the front side within the upper cover 11 in such a way that the centroid G of the upper cover 11 comes to the position closer to the front end than to the center C of the upper cover 11 shown in FIG. 2, the inventive concept of the present invention is not limited to the configuration. Specifically, the control substrate 15 and a sheet-metal member 16 may not be provided within the upper cover 11, so long as the centroid G of the upper cover 11 is positioned at an opposite side to the center C of the upper cover 11 with respect to of the fulcrum f. Moreover, a sheet-metal member 16 may not be provided (only the control substrate 15 is arranged within the upper cover 11 in such a way that the centroid G of the upper cover 11 is positioned at an opposite side the center C of the upper cover 11 with respect to the fulcrum f).

In the exemplary embodiment, the color printer 1 having the four LED units 40 and the four process cartridges 50 is explained. However, the inventive concept of the present invention is not limited to this exemplary embodiment. Specifically, the exemplary embodiment of the present invention can be applied to an image forming apparatus having one photosensitive element and one exposure member (e.g., a monochrome printer).

In the above exemplary embodiment, the photosensitive drums 53, the coil springs 130 and the coil springs 43 are explained. However, the inventive concept of the present invention is not limited thereto. For example, an endless-belt-shaped photosensitive element or a flat-surface-shaped photosensitive element may also be adopted in place of the photosensitive drums 53. Further, a leaf spring, or the like, may also be adopted in place of the coil springs 130 or the coil springs 43.

The shape of the lock mechanism 100 (the engagement protrusion 110 and the latch claw 120) is not limited to the shape described in the present exemplary embodiment. No specific limitations are imposed on the shape, so long as the lock mechanism 100 obtains an effect analogous to that obtained in the exemplary embodiment.

What is claimed is:

1. An image forming apparatus comprising:

a housing including a photosensitive member and having an opening at an upper portion of the housing;

an upper cover connected to the housing at one end of the upper cover via a hinge and configured to move between an opened state in which the upper cover does not cover the opening and a closed state in which the upper cover covers the opening;

an exposure unit supported by the upper cover and configured to face the photosensitive member when the upper cover is in the closed state; and a lock mechanism, wherein the lock mechanism is releasable by lifting the upper cover so that the upper cover becomes to the opened state.

2. The image forming apparatus according to claim 1, wherein the upper cover includes an operational part, and wherein the lock mechanism is released when the operational part is lifted upward.

3. The image forming apparatus according to claim 2, wherein the upper cover further includes a control substrate which controls light emission of the exposure unit, and wherein the control substrate is arranged at the position closer to the operational part than to the hinge.

4. The image forming apparatus according to claim 3, wherein the upper cover further includes a metal plate, and wherein the control substrate is disposed between the upper cover and the metal plate.

5. The image forming apparatus according to claim 1, wherein the lock mechanism includes:

an engagement protrusion;

a latch claw which engages with the engagement protrusion when the upper cover is in the closed state; and a first urging member which urges the engagement protrusion toward the latch claw, wherein the engagement protrusion is pivotably supported in a direction in which the engagement protrusion approaches and separates from the latch claw.

6. The image forming apparatus according to claim 5, wherein the engagement protrusion and the first urging member are disposed on the upper cover, and wherein the latch claw is disposed on the housing.

7. The image forming apparatus according to claim 5, wherein a maximum value of an engagement force occurring between the engagement protrusion and the latch claw at an engagement point is smaller than a downward force which acts on the engagement point between the engagement protrusion and the latch claw and which occurs due to a weight of the housing.

8. The image forming apparatus according to claim 7, further comprising a second urging member which urges the exposure unit toward the photosensitive member when the upper cover is in the closed state, wherein a sum of a maximum value of the engagement force of the lock mechanism and a gravity force due to the weight of the upper cover is greater than a maximum value of an upward force due to the second urging member.

9. The image forming apparatus according to claim 5, wherein each of the engagement protrusion and the latch claw includes a slope, and wherein, when a downward force is applied to the upper cover before the engagement protrusion engages with the latch claw, the first urging member is elastically deformed and the slope of the engagement protrusion slidably contacts the slope of the latch claw.

10. The image forming apparatus according to claim 1, wherein a centroid of the upper cover is positioned between the other end of the upper cover and a center of the upper cover between the one end and the other end of thereof.

11. The image forming apparatus according to claim 10, wherein the upper cover includes a control substrate which controls light emission of the exposure unit, and wherein the control substrate is arranged so that the centroid of the upper cover is positioned between the other end and the center of the upper cover.

12. The image forming apparatus according to claim 11, wherein the upper cover further includes a sheet-metal member disposed opposite the control substrate, and wherein the sheet-metal member is arranged so that the centroid of the upper cover is positioned between the other end and the center of the upper cover.

13. The image forming apparatus according to claim 1, wherein the upper cover includes a grip provided at a center portion along an edge on the other end thereof.

14. The image forming apparatus according to claim 1, wherein the exposure unit includes:

a plurality of light emitting diodes which selectively emits light;

a head which supports the plurality of light emitting diodes; and a frame which covers the head.

15. An image forming apparatus comprising:

a housing including a photosensitive member and having an opening at an upper portion of the housing;

an upper cover connected to the housing at one end of the upper cover via a hinge and configured to move between an opened state in which the upper cover does not cover the opening and a closed state in which the upper cover covers the opening;

an exposure unit supported by the upper cover and configured to face the photosensitive member when the upper cover is in the closed state;

a lock mechanism including:

a first lock member which is provided to the upper cover;

a second lock member which is provided to the housing; and an urging member configured to urge the first lock member to the second lock member so that the first lock member and the second lock member engage with each other when the upper cover is in the closed state, wherein when the upper cover is lifted from the closed state to the opened state, the first lock member slidably contacts with the second lock member so that the engagement between the first lock member and the second lock member is released.

* * * * *